United States Patent [19]

Fundom et al.

[11] Patent Number: 4,524,879

[45] Date of Patent: Jun. 25, 1985

[54] CAN END POUR SPOUT AND PULL TAB CONSTRUCTION

[75] Inventors: Danny L. Fundom; William A. Kirk, both of Massillon, Ohio

[73] Assignee: Van Dorn Company, Massillon, Ohio

[21] Appl. No.: 621,541

[22] Filed: Jun. 18, 1984

[51] Int. Cl.[3] ..... B65D 17/36

[52] U.S. Cl. ..... 220/273

[58] Field of Search ..... 220/269–273

[56] References Cited

U.S. PATENT DOCUMENTS

| | | | |
|---|---|---|---|
| 3,204,805 | 9/1965 | May | 220/270 |
| 3,221,924 | 12/1965 | Harvey et al. | 220/271 |
| 3,251,515 | 5/1966 | Henchert et al. | 220/271 |
| 3,259,265 | 7/1966 | Stuart | 220/270 |
| 3,322,296 | 5/1967 | Khoury | 220/273 |
| 4,042,144 | 8/1977 | Henning et al. | 220/273 |
| 4,399,925 | 8/1983 | Fundom | 220/269 |

*Primary Examiner*—George T. Hall

*Attorney, Agent, or Firm*—Frease & Bishop

[57] ABSTRACT

A steel can end construction for a special liquid product to be protected against contamination in which a pouring opening is to be formed in the can end by pulling the can end metal area defined by an endless score line with a centrally located aluminum pull tab riveted to the steel can end to completely tear the metal within the score line from the can end. The tearing operation is performed by a person holding the can in one hand and with a finger or thumb engaged with the pull tab, pulling the pull tab upward and forward from the can.

14 Claims, 27 Drawing Figures

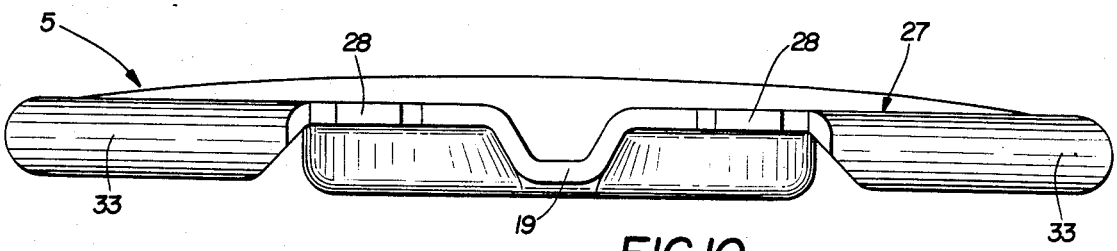
FIG.10
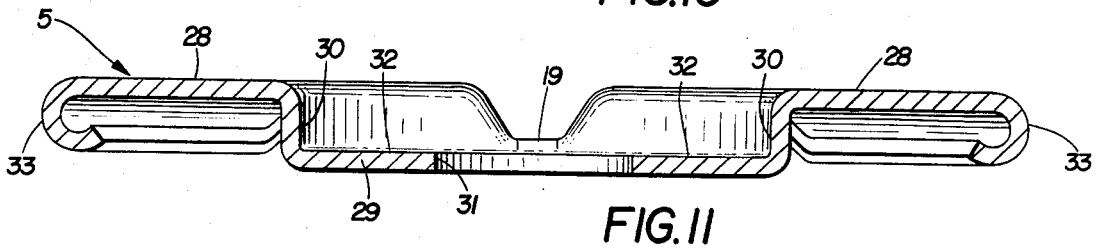
FIG.11
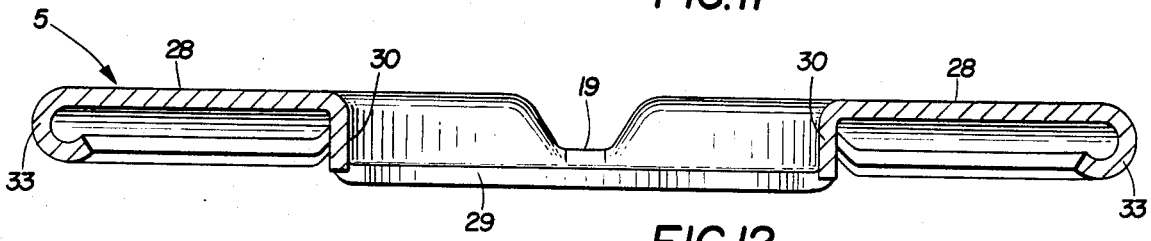
FIG.12
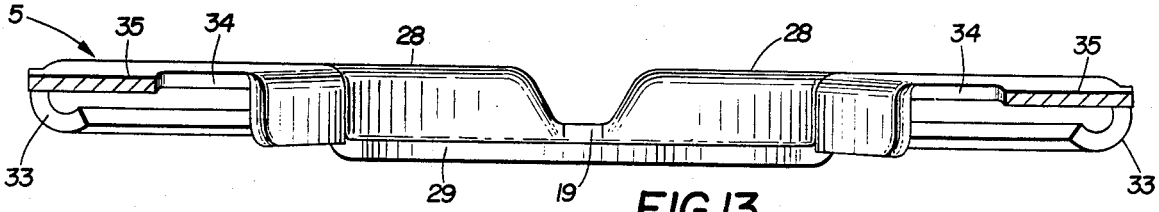
FIG.13
FIG.19
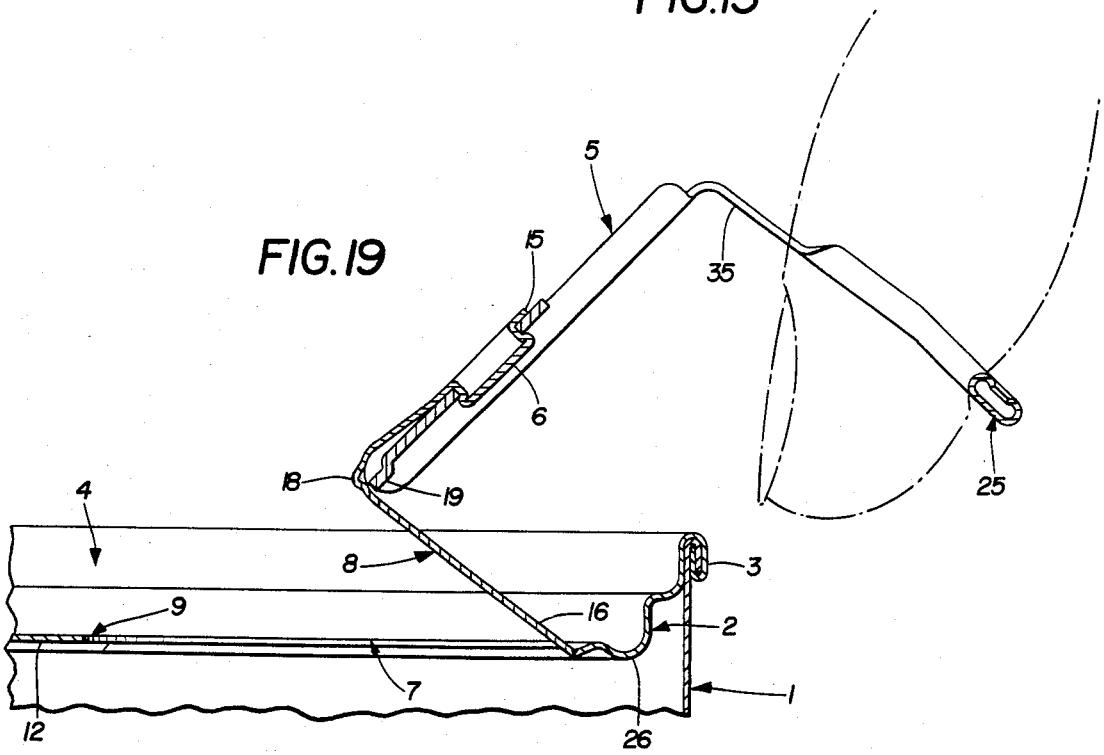

CAN END POUR SPOUT AND PULL TAB CONSTRUCTION

CROSS-REFERENCE TO RELATED PATENTS

The can end pour spout and pull tab construction of this application is an improvement upon the pouring spout steel can end construction of U.S. Pat. No. 4,399,925, and upon the pull tab construction of U.S. Pat. No. 4,042,144, both of which are owned by the Assignee of this application.

BACKGROUND OF THE INVENTION

1. Field of the Invention

The invention relates to a metal can for liquids and more particularly for special liquid formulas for adults and children containing high calorie liquid food providing complete, balanced nutrition, and other similar liquid supplement preparations that must not be contaminated.

More particularly, the invention relates to a can for such liquid products having a can end member which may be opened easily by tearing loose a small generally teardrop or pear-shaped metal area from the flat circular metal panel portion of the can end member to form a pouring spout opening in said panel. The torn out teardrop-shaped metal area and pouring spout opening are defined by an endless score line. A pull tab is riveted to the metal area to be torn from the panel at a zone adjacent the center of the circular panel and the pull tab is used to completely remove the metal area within the score line from the panel.

Further, the invention relates to a metal can end member with a pull tab having nose and ring pull portions with the pull tab nose portion riveted to the circular panel as aforesaid so that the pouring spout opening metal area may be completely removed from the can end member by a person holding the can in one hand and grasping the pull tab ring portion with a finger of the other hand and pulling the ring portion upward and toward the person manipulating the pull tab to open the can.

Also, the invention relates to such a can end member fabricated from light gauge steel to which an aluminum pull tab is riveted and in which the described pulling of the pull tab upward and toward the person opening the can prevents any portion of the metal area being removed from the panel to form the pouring spout opening from entering the can, thereby preventing contamination of the can contents by and during opening of the can.

Further, the invention relates to the described can end construction in which the pull tab structure is weakened in certain locations to permit the described opening procedure to be carried out easily; and in which the pull tab is strengthened in its nose portion to prevent rivet pullout, on the one hand, and to enable bending of the torn out metal area immediately in front of the rivet, on the other hand, to facilitate easy tear-out of the metal area being removed from the panel defined by the endless score line described.

The invention relates further to the new teardrop shape or pear shape of the pouring opening to be formed in the can end, and more particularly to a shape defined by an endless score line which enhances the tear value of the tearing force required to tear the metal area from the can end panel completely to form the pouring opening.

Also, the invention relates to the described can end construction in which the panel of the can end located adjacent the lower end of an annular shouldered countersink wall which extends downward from the outturned can end flange which is seamed to the upper end of the can side wall, is located so that the pull tab riveted to the central portion of the panel will not move upward beyond the top of the can seam to interfere with processing equipment, when the can filled with the liquid composition is heated during processing of the contents of the can, which causes bulging of the panel.

Further, the rivet connection between the pull tab and panel is enlarged in size, along with pull tab nose strengthening, to increase the strength of the rivet to prevent rivet pull out during pull tab manipulation to provide the pouring spout opening for the can.

Further, strengthening of the panel to maximize the condition of panel flatness and resistance to panel distortion during can opening is provided by a number of downward panel embossments at a number of locations within the flat circular metal panel portion.

One of these is a short straight tip embossment located close to the rivet below the tip of the pull tab to space the embossed valley from the pull tab tip to permit the pull tab to move downward at the beginning of can opening before the tab tip engages the panel metal as the metal within the endless score line is being torn out.

A crescent-shaped embossment is formed in the panel behind the rivet and outside of the semi-circular score line portion that partially surrounds the rivet. This crescent-shaped embossment takes up metal for maintaining panel flatness.

Also, two angularly arranged straight embossments straddle the ends of the crescent embossment which also help to maintain panel flatness.

A thumb embossment is formed in the panel having a horseshoe shape adjacent and extending from the periphery of the panel in a ramplike manner toward the center of the panel beneath the pull ring portion of the pull tab to enable a finger or thumb to be entered below the ring portion of the pull tab for bending the pull tab ring portion upward to start the opening operation.

Finally, a shallow circular beadlike embossment is formed at the periphery of the flat circular metal panel connecting the panel with the lower end of the annular countersink wall portion. This circular bead stiffens the panel which assists in maintaining panel flatness which should be maintained as flat as possible at all times.

The maintenance of flatness in the circular panel and in the area to be torn out within the endless score line is important to provide maximum strength against rupture of the score line if a filled can is accidentally dropped.

2. Description of the Prior Art

There are known steel can ends formed with pouring spout openings for cans containing special liquids as in U.S. Pat. No. 4,399,925, wherein the can is opened in a typical manner with a known type of aluminum pull tab such as shown in U.S. Pat. No. 4,042,144.

However, a need has developed for a pouring spout opening can end construction in which the pouring spout opening may be formed by an individual holding the can in one hand and grasping with a finger or thumb of the other hand a pull tab which may be pulled upward and then forward toward the individual holding the can to completely remove the metal area defined by an endless score line formed in the circular metal can end panel portion.

The described special opening procedure cannot be carried out on a can provided with a can end and pull tab such as shown in said U.S. Pat. Nos. 4,042,144 and 4,399,925, since opening of a pouring spout in a typical manner as shown and described in U.S. Pat. No. 4,399,925 involves pulling the pull tab away from the individual opening the can.

Beverage cans are known in which a drinking opening is formed in a metal can end by tearing metal defining the drinking opening from the can end with a strip metal pull tab riveted at one end to an end of the metal to be torn away at a central location of the can end. This type of beverage can is opened by pulling the pull tab toward the person opening the can. The opening of such a can is quite difficult because of the shape of the flat striplike metal pull tab which normally lies flatwise with full interface surface contact between the pull tab and can end, and because of the magnitude of force required to initiate tearing of the panel metal in a portion of the score line defining the opening, located in the panel at a zone behind the rivet and beneath the strip metal pull tab. Examples of such known construction are shown in U.S. Pat. Nos. 3,204,805 and 3,259,265.

Another can construction shown in U.S. Pat. No. 3,221,924 has various forms of an aluminum opener in elongated strip form having two portions hinged together or otherwise separately relatively movable, one riveted to a panel area of the can end metal which when removed forms a pour opening, and the other riveted to another portion of the can end metal to be removed to form a vent opening. The lever actions of the two-part lever opener in this construction are dependent on first forming the vent opening, and then the pour opening. During manipulation of the flat strip metal opener, the removed metal portion projects into the can during the opening operation.

Another prior art U.S. Pat. No. 3,251,515 protects a preformed pouring opening with an adhesive strip covering the opening. The strip is pulled away to expose the opening. Thus, portions of the protective cover strip do not enter the can during opening, but such construction is not feasible for cans containing special formula foods that are processed in sealed cans by heating.

U.S. Pat. No. 3,322,296 shows another known construction of metal pull tab having a reinforced nose portion and a full circular ring portion connected by a narrow metal bendable hinge portion. The pull tab nose is riveted to the can end panel adjacent a full opening circular score line formed in the panel. The pull tab bends during the opening operation during which a portion of the can end panel is projected into the container when the score line is ruptured to initiate tearing of the circular panel portion completely from the can end.

None of the various prior art devices described have any construction which satisfies present requirements set forth in detail above for a can end construction for special liquid food products which must not be contaminated and which may be contained in a can provided with a steel can end with an aluminum pull tab manipulated by pulling the pull tab upward and then toward the individual holding the can to completely remove the metal area from the panel to form a pouring opening without any of the removed metal entering the can at any time during opening.

Accordingly, there is an existing need in the art for a can for special liquid food products heat processed in a sealed can provided with a steel can end which may be opened easily with an aluminum pull tab riveted to the can end panel generally centrally of the panel, which pull tab may be manipulated in the manner described to completely remove the metal area from the panel to form a pouring opening defined by an endless score line without contaminating the contents of the can by projecting any part of the pull tab or removed metal portion into the can during opening.

SUMMARY OF THE INVENTION

Objectives of the invention include providing a new steel can end construction having a flat circular panel portion in which a small teardrop-shaped or pear-shaped pouring opening is formed by completely tearing away from the flat panel a metal area defined by an endless score line without entering any of the torn out metal into the can or its contents at any time during the opening of the can; providing such a can end construction which may be easily opened with an aluminum pull tab generally similar to a known pull tab construction the manufacturing equipment for which is available, wherein the known pull tab construction is modified to strengthen its nose portion and weaken the connection between such nose portion and an integral ring pull portion to permit ready bending of the pull tab at said weakened connection, and wherein said modified pull tab construction may be readily manufactured with modified dies in said available manufacturing equipment; providing such can end construction in which such modified pull tab strengthened nose portion is riveted to the panel near to the central portion of the circular panel with a strengthened rivet at a location within the endless score line defining the shape or contour of the pouring opening to be formed by complete removal of the metal area within the score line, and wherein said rivet location is at the narrow or inner end of the metal area to be removed so that the contour of the generally pear-shaped opening extends and widens outward from the rivet to a zone adjacent the periphery of the flat circular panel; providing such can end construction in which the circular panel is strengthened to maximize maintenance of a condition of panel flatness at all times to resist panel distortion during can opening, by forming a number of downward embossments at a number of locations or regions within the flat circular metal panel portion and at the panel connection with the lower end of an annular countersink wall which extends downward from an out-turned flange portion of the can end which becomes part of the double seam connection of the can end with the can side wall when the can end is seamed to said side wall; providing such a can end construction in which the shape or contour of the generally pear-shaped opening defined by the endless score line which enhances the tear value of the tearing force required to tear the metal area from the can end panel commencing behind the rivet and continuing outward along the widening side portions of the pear-shaped opening; providing such a can end construction in which the pouring opening may be formed by an individual grasping the can in one hand and pulling with a finger or thumb of the other hand, the ring portion of the pull tab upward to a position extending approximately at right angles to the can end panel and then pulling the ring portion forward toward the individual opening the can so as to initially rupture the score line at a zone behind the rivet and to then bend the metal area immediately in front of the rivet followed by peeling the metal area being removed outward along the widening contour of the pouring opening being formed to its wide end portion adjacent the periphery of the flat circular panel; providing such a can end construction in which the circular panel at the lower end of the annular countersink wall, with the pull tab generally centrally riveted to the panel, is located sufficiently below the out-turned can end flange which is seamed to the can side wall, that the pull tab will not move upward beyond the top of the can seam to interfere with processing equipment when the can filled with its liquid composition is heated during processing of the contents of the can which causes upward bulging of the panel; and providing such a new steel can end construction which achieves the stated objectives, which overcomes difficulties encountered in prior constructions, and which satisfies the described need which has developed in connection with a can end for a can for special formula food products.

These and other objectives may be obtained by the new can end construction of the invention which may be stated in general terms as involving a steel can end of the type having a seam flange adapted to be connected by seam means to a can body, in which said can end has a recessed corner located below said seam flange with a flat circular panel extending inward from said recessed corner, in which a score line is formed in said panel defining a metal area to be torn from said panel by an aluminum pull tab having a ring portion and a nose portion, and in which said nose portion is riveted to said metal area so that pulling of the pull tab tears said metal area from the panel to form a pouring opening, wherein the improvement comprises: a steel can end having an endless score line formed in said panel, in which said score line has a generally pear shape extending radially from a small rounded inner end located adjacent the center of the panel to a larger rounded outer end located adjacent the periphery of the panel, and has outwardly diverging straight sides connecting said inner and outer rounded ends to define the pouring opening to be formed in the can end panel; the nose portion of said aluminum pull tab riveted to said panel metal area has flat top and bottom panels and an enlarged rivet opening formed in said nose bottom panel, the nose bottom panel being integrally connected laterally at each side of said rivet opening through spaced inner nose shoulder walls directly with said nose top panel, said nose top and bottom panels and spaced shoulder walls converging to form a stepped tip, and said integral lateral connections of the nose bottom panel with the nose top panel strengthening and stiffening said flat nose bottom panel against bending between said rivet opening and said stepped tip when the pull tab is pulled to form a pouring opening in said can end panel; the can end panel metal area within the small rounded inner end of said pear-shaped endless score line is formed with concentric integral rivet means which extends through said enlarged rivet opening in said flat nose bottom panel and is riveted to said flat nose bottom panel, whereby the stiffened flat nose bottom panel is held at all times in contact with said can end panel metal area within said score line; and the ring portion of said pull tab integral with said nose portion has weakened connection with said nose portion to permit ready bending of the pull tab at said weakened connection when the pull tab is pulled to form a pouring opening in said can end panel; whereby the metal area within the endless score line may be completely torn from the can end by a person holding the can in one hand and grasping the tab pull ring portion with a finger or thumb of the other hand and pulling the tab ring portion upward and forward toward the person to first bend the pull tab at said weakened connection and then to initially rupture the score line behind and around the rivet means, accompanied by lever action of the contiguous pull tab nose flat bottom panel and contacted can end metal area within the score line applied by pull tab nose tip engagement with said metal area to form a bend in said metal area in front of said nose tip while tearing along the score line to such bend, and then by continuing forward pulling, completely tearing the metal area from the can end panel along the remainder of the score line to the rounded outer end of the score line to form a pouring opening.

BRIEF DESCRIPTION OF THE DRAWINGS

A preferred embodiment of the invention—illustrative of the best mode in which Applicants have contemplated applying the principles—is set forth in the following description and shown in the drawings and is particularly and distinctly pointed out and set forth in the appended claims.

FIG. 10 is an end view of the pull tab shown in FIG. 7 looking in the direction of the arrows 10—10, FIG. 7;

FIG. 11 is a section through the rivet-receiving hole formed in the nose portion of the pull tab shown in FIG. 7 looking in the direction of the arrows 11—11, FIG. 7;

FIG. 12 is a sectional view similar to FIG. 11 through the nose portion of the pull tab shown in FIG. 7 at another location looking in the direction of the arrows 12—12, FIG. 7;

FIG. 13 is a section looking in the direction of the arrows 13—13, FIG. 7 through the weakened portions forming the connection between the nose and pull ring portions of the pull tab;

FIG. 19 is a view similar to FIGS. 14, 17 and 18 showing the final stage of pull tab manipulation just before the metal area being removed from the panel to form the pouring opening is completely torn from the panel;

Similar numerals refer to similar parts throughout the various figures of the drawings.

DESCRIPTION OF THE PREFERRED EMBODIMENT

Figure 1:
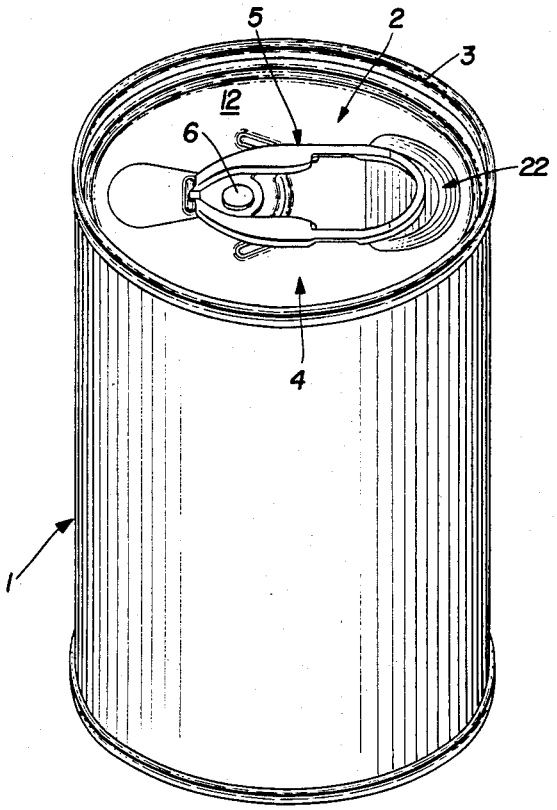
FIG. 1 is a perspective view of a can filled with liquid the upper end of which is closed by the improved can end construction.
Figure 27:
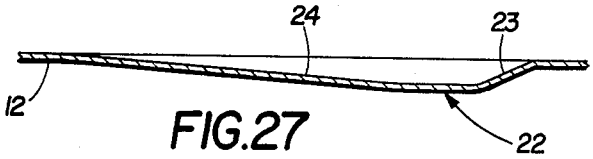
FIG. 27 is a sectional view illustrating the ramplike thumb recess formed in the panel behind the crescent and diagonal recesses adjacent the periphery of the circular panel portion of the can end member.
Figure 24:
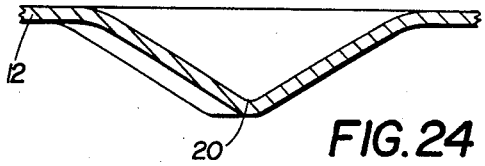
FIG. 24 is a fragmentary sectional view of the crescent-shaped recess located behind the rivet opening in the panel taken on the line 24—24, FIG. 2.

A generally typical steel can body 1 is illustrated in FIG. 1 with the improved can end assembly generally indicated at 2 seamed at 3 to the upper end of the side wall of the can body 1. The can end assembly 2 comprises a new steel can end member indicated at 4, and a new aluminum pull tab member indicated at 5 riveted at 6 to the steel can end 4.

Figure 6:
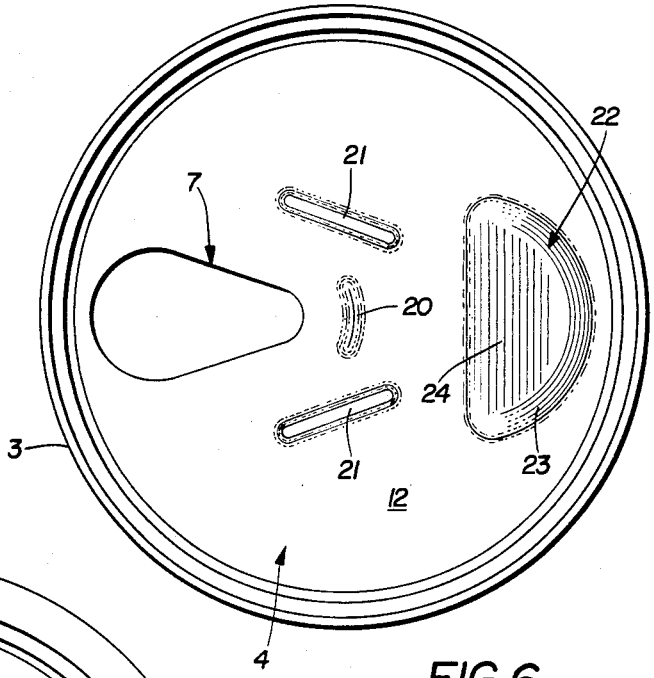
FIG. 6 is a top plan view of a can illustrating the new can end and pull tab seamed to the can as shown in FIG. 1 but after the can has been opened to form the pouring spout in the can end circular panel.
Figure 2:
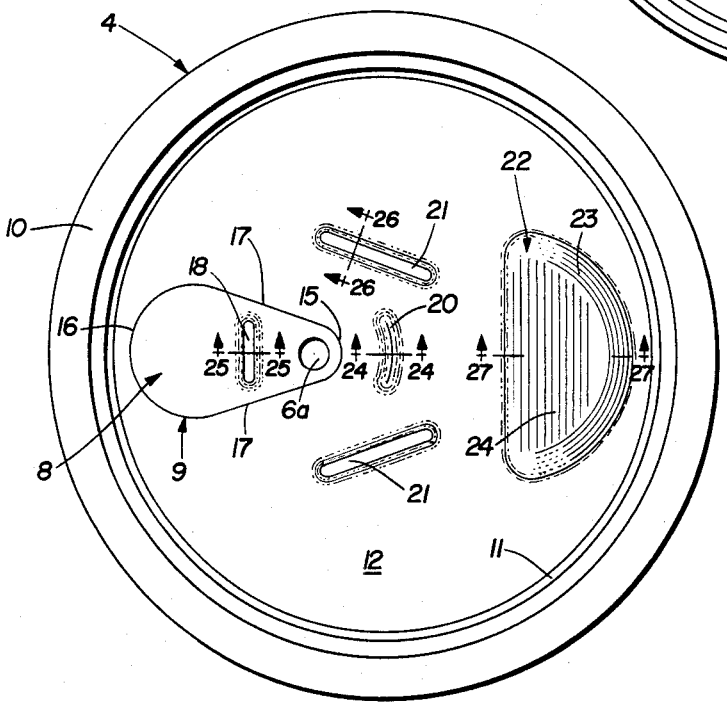
FIG. 2 is a plan view of the can end circular panel portion in its state or stage after forming but before having a pull tab riveted thereto and before being seamed by a typical double seam to the upper end of the can side wall as shown in FIG. 1.
Figure 25:
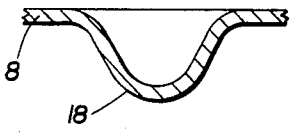
FIG. 25 is a sectional view illustrating the tip recess formed within the endless score line in front of the rivet opening in the panel taken on the line 25—25, FIG. 2.
Figure 26:
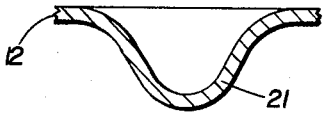
FIG. 26 is a sectional view of one of the diagonal recesses formed in the panel taken on the line 26—26, FIG. 2.
Figure 4:
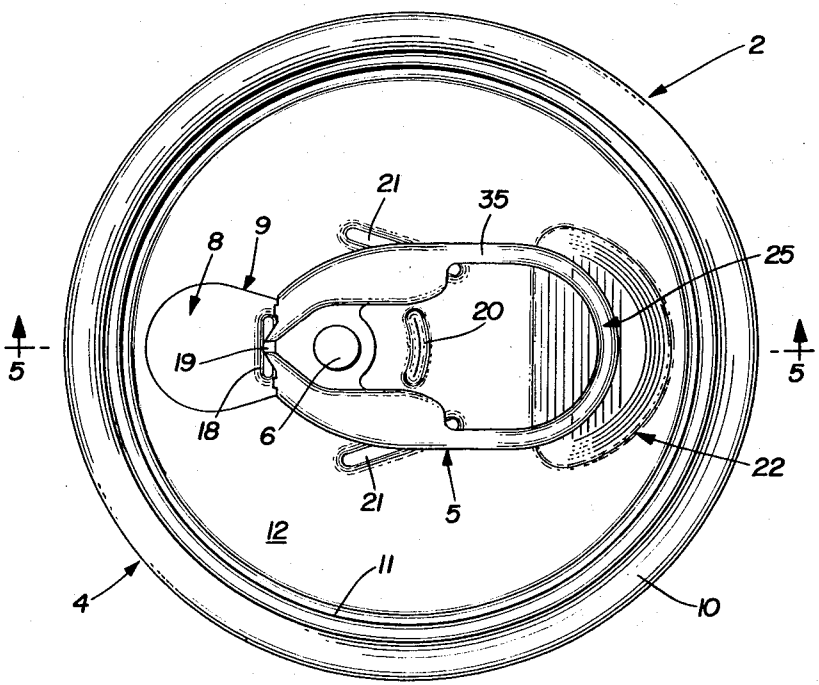
FIG. 4 is a top plan view of the can end shown in FIG. 2 after a pull tab has been riveted thereto.
Figure 3:
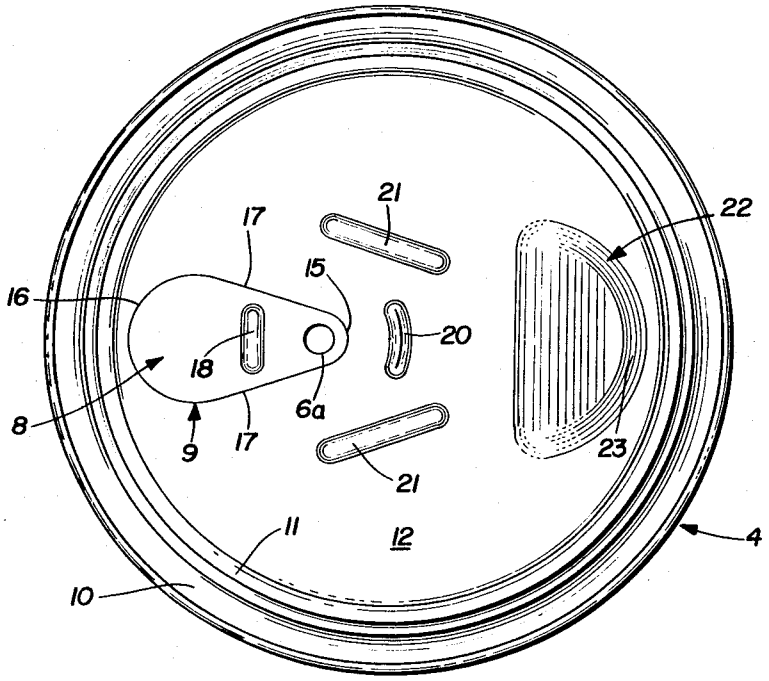
FIG. 3 is a bottom plan view of the can end stage blank shown in FIG. 2.
Figure 5:
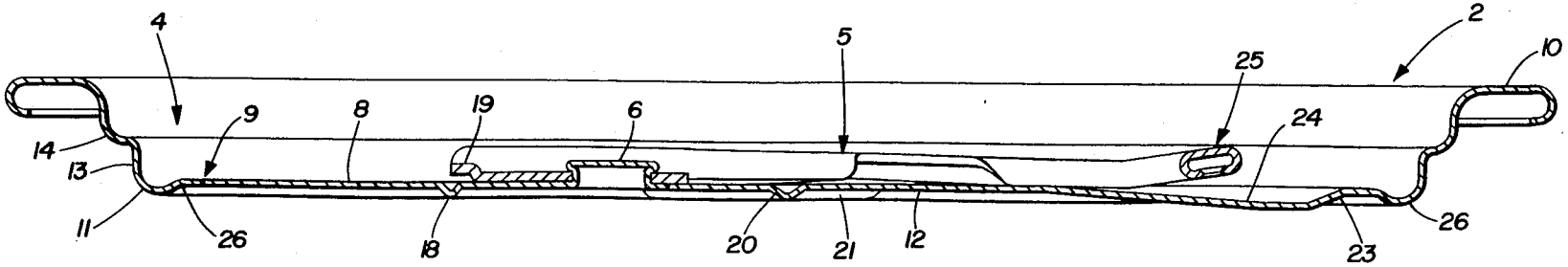
FIG. 5 is an enlarged section taken on the line 5—5, FIG. 4.

The new can end assembly 2 is best illustrated in FIGS. 4 and 5 ready to be seamed to a can after the can 1 has been filled at a canning plant with the desired contents (FIG. 1). The steel can end member 4, prior to having an aluminum pull tab 5 riveted thereto, is shown in FIGS. 2 and 3. The steel can end member 4 also is shown in FIG. 6 seamed to a can, in its condition after the pouring opening generally indicated at 7 has been formed therein by complete removal of the metal area generally indicated at 8 (FIGS. 2 and 3) defined by the score line 9.

The steel can end member 4 has a seam flange 10 which becomes a part of the seam 3 when the member 4 is seamed to the can body 1. The member 4 has a recessed corner 11 located below the seam flange 10, and a flat circular panel 12 extends inward from the recessed corner 11.

The recessed corner 11 is located at the lower end of an annular countersink wall 13, shouldered at 14, which extends downward from the out-turned seam flange 10. In this manner the flat circular panel 12 is located sufficiently below the out-turned seam flange 10 that the pull tab member 5 located above and riveted to the central portion of the panel 12 cannot move upward beyond the top of the seam 3 to interfere with canning plant processing equipment when a filled can 1 is heated during processing of its contents.

Such heating causes upward bulging of the panel 12 to a considerable extent, depending upon the time and temperature of heating. Thus the depth of the annular countersink wall 13 is used to prevent the occurrence of any problems related to canning plant heat processing of canned products.

A number of new features are incorporated in the panel 12 of the steel can end member 4. The rivet connecting the can end and pull tab members 4 and 5, shown at *6a* in FIGS. 2 and 3 before riveting, is enlarged from the rivet present in U.S. Pat. No. 4,399,925. The larger rivet 6 provides additional strength to prevent rivet pull-out during opening of the can 1.

The shape of the score line 9 is changed from that in said prior device. The score line 9 has an endless pear shape which extends radially from a small rounded inner end portion 15 located adjacent the center of the panel 12 to a larger rounded outer end portion 16 located adjacent the periphery of the panel 12. Outwardly diverging straight side portions 17 tangentially connect said inner and outer rounded ends 15 and 16 to complete the pear shape. This shape not only defines the pouring opening 7 (FIG. 6) to be formed in the panel 12, but also defines the shape of the metal area 8 to be torn from the panel 12 to form the pouring opening 7.

The rounded end portions 15 and 16 preferably are formed as portions of circles. The rounded inner end portion 15 is concentric with the rivet *6a* to be formed. The particular shape or contour of the endless score line 9 is important in that it enhances the tear value of the tearing force required to tear the metal area 8 from the panel 12 completely to form the pouring opening 7.

This tearing force is applied to the panel metal by the pull tab member 5 riveted to the panel as described in detail below. When the tearing force is applied it commences score line rupture behind the rivet and the tearing continues outward along the widening straight side portions 17 of the score line 9 to the larger rounded outer end portion 16 to completely sever the metal area 8 from the panel 12 to form the pouring opening 7. Thus, the enhanced tear value enables the can 1 to be opened easily.

The new features incorporated in the steel can end member 4 include a number of downward panel embossments or recesses at a number of locations in the panel 12. These embossments cooperate and combine to maximize maintenance of a condition of panel flatness and resistance to panel distortion during can opening.

One of these features is a short straight tip recess 18 located close to and in front of the rivet 6 in the metal area 8 beneath and spaced from the stepped tip 19 of the pull tab 5 (FIG. 4). This spaces the recess valley of the tip recess 18 from the pull tab tip 19 a sufficient distance to permit the pull tab tip to move downward without restraint at the beginning of the can opening procedure, before the tip 19 engages metal in the panel 12. This period of unrestrained movement of the pull tab tip 19 enables the entire pulling force imparted to the pull tab by the person opening a can to act during the unrestrained period as the pull tab is pulled upward and, with slight rocking movement, to initially rupture the score line behind the rivet 6 at the inner rounded end 15 of the score line.

After the pull tab ruptures the score line behind the rivet, tearing along the score line of the metal area 9 from the panel 12 continues, as more fully described below in connection with FIGS. 14 and 17.

Another panel stiffening recess is the crescent shaped recess 20 formed in the panel 12 behind the rivet 6*a* (FIG. 2) and outside of the score line small rounded inner end 15. This crescent shaped recess takes up metal for maintaining panel flatness.

Other embossed recesses comprise the two angularly arranged straight recesses 21 which straddle the ends of the crescent shaped recess 20 and combine with the other recesses to maintain flatness of the panel 12.

A thumb embossed recess 22 is formed in the panel 12 having a horseshoe shape 23 adjacent and extending from the periphery of panel 12 in a ramplike manner 24 toward the center of the panel 12 beneath the pull tab ring portion 25. This ramplike thumb recess enables a finger or thumb to be entered below the pull tab ring portion 25 and the ring portion to be pulled upward to bend the ring portion 25 upward to start the can opening operation as shown in FIG. 14.

Cooperating with the recesses 18, 20, 21 and 22 to maintain flatness and stiffness of the circular panel 12 is a shallow circular beadlike embossed recess 26 formed at the periphery of the flat circular metal panel 12 connecting the panel 12 with and forming part of the recessed corner 11 at the lower end of the annular countersink wall 13. This circular bead 26, as stated, stiffens the panel 12 and assists in maintaining flatness which should be maintained to the maximum extent possible at all times.

The maintenance of flatness in the circular panel 12, as well as in the metal area 8 within the score line 9 is very important to provide maximum strength against rupture of the score line if a filled can is accidentally dropped.

The shoulder 14 in the annular countersink wall 13, intermediate the seam flange 10 and recessed corner 11 cooperates with the various embossed recesses in the panel 12 in maintaining strength, stiffness and flatness of the panel wall 12 at all times.

A number of new features are also incorporated in the aluminum pull tab member 5 of the can end assembly 2. The nose portion 27 of the pull tab 5 which contains the pull tab tip 19 is strengthened from the pull tab construction disclosed in U.S. Pat. No. 4,042,144. Along with such strengthening, the connection between the pull tab nose portion 27 and the pull tab ring portion 25 is weakened.

The strengthening of the pull tab nose portion 27 is accomplished by providing spaced flat top nose panel portions 28 and a flat nose bottom panel portion 29, spanning the spaced top panel portions 28, and connected to the spaced inner nose shoulder walls 30. The flat nose bottom panel portion 29 has a rivet opening 31 formed therein. Bottom panel 29 is integrally connected laterally at 32 at each side of the rivet opening 31 with the inner nose shoulder walls 30 to maintain the flat nose bottom panel 29 rigid and flat throughout so as to prevent relative movement between the flat nose top and bottom panels 28 and 29 at any time.

This strengthening and stiffening of the flat nose bottom panels 29 holds said bottom panel 29 against bending between the rivet opening 31 and the tip 19 of the pull tab at all times and particularly when the pull tab 5 is riveted to the can end panel 12 and is pulled to form a pouring opening in said panel 12.

This new strengthened feature of the pull tab nose portion 27 is in contrast with the nose portion of said prior art pull tab wherein the bottom panel ear which is riveted to the can end panel bends immediately in front of the rivet and between the rivet and pull tab tip to enable the pull tab tip to press downward on the score line portion immediately adjacent the periphery of the can end panel.

In addition to this strength feature of the nose portion 27 of the pull tab 5, the rivet opening 31 formed in the nose bottom panel 29 is larger than the rivet opening in the prior construction so that a larger and stronger rivet 6 may be used to join the pull tab 5 to the can end 4.

The combined strengthening of the rivet 6 and the pull tab nose portion 27 enables the complete flat nose bottom wall panel 29 to be held at all times by the rivet 6 in complete surface-to-surface contact with the surface of the can end panel metal area 8 within the score line 9 from the rear of the nose bottom panel 29 to the tip 19 of the pull tab 5.

Thus, the pull tab nose portion 27 can act as a lever when the rear of the pull tab nose portion is pulled upward to pull the riveted connection upward at the rear of the flat nose bottom panel 29 initially to tear the metal area 8 along the score line 9 at the inner rounded end 15 thereof.

Figure 7:
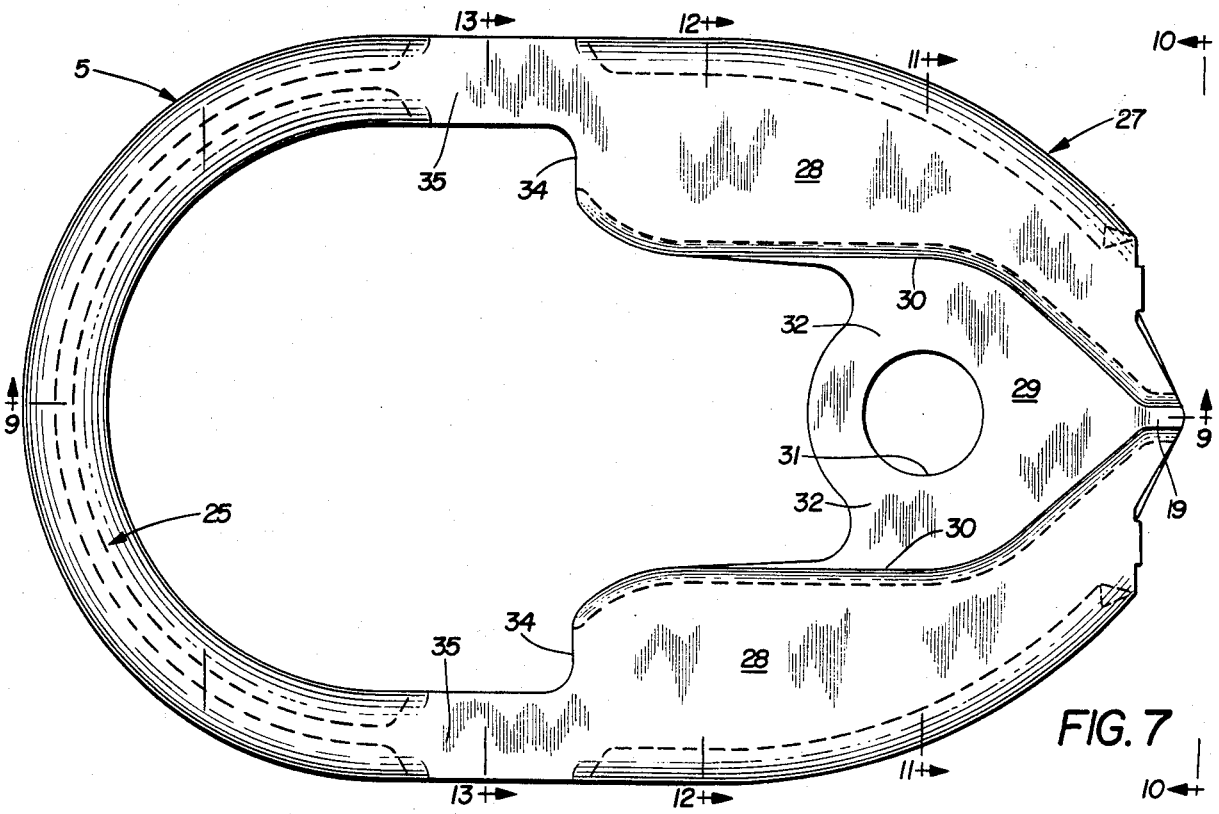
FIG. 7 is a top plan view on an enlarged scale of the pull tab which forms a part of the new can end construction.
Figure 8:
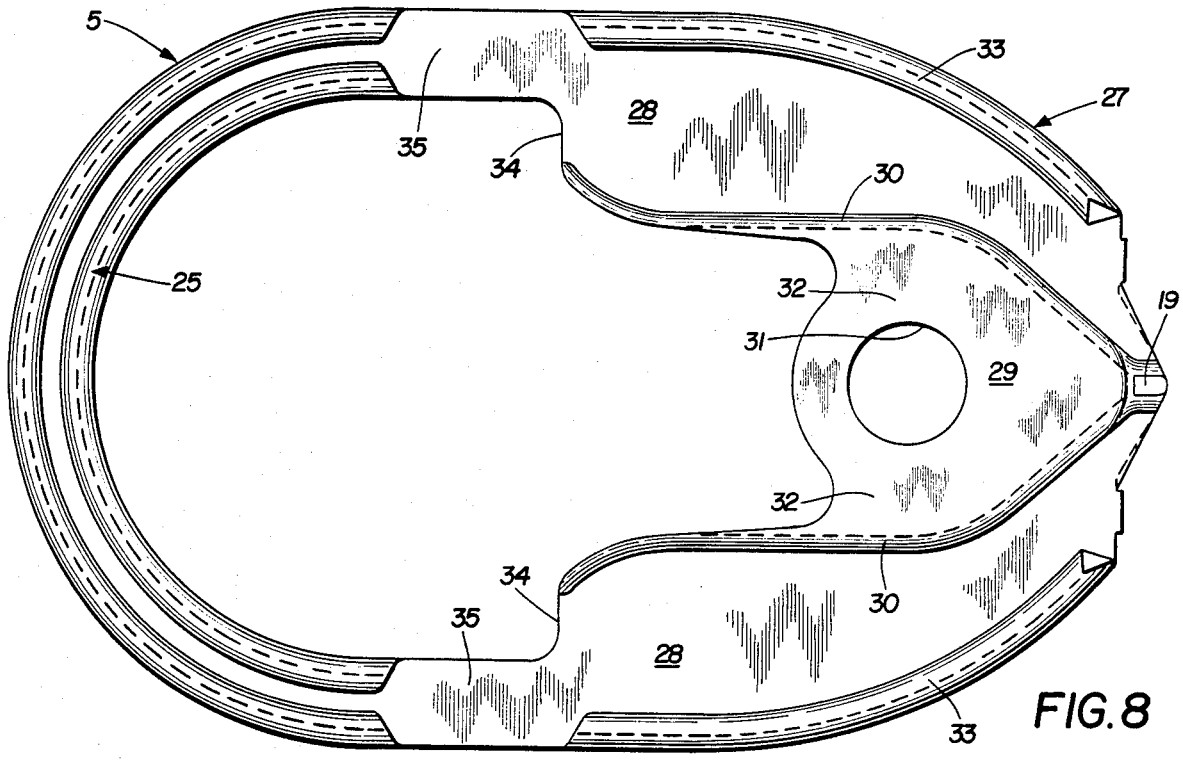
FIG. 8 is a bottom plan view of the pull tab shown in FIG. 7.
Figure 9:
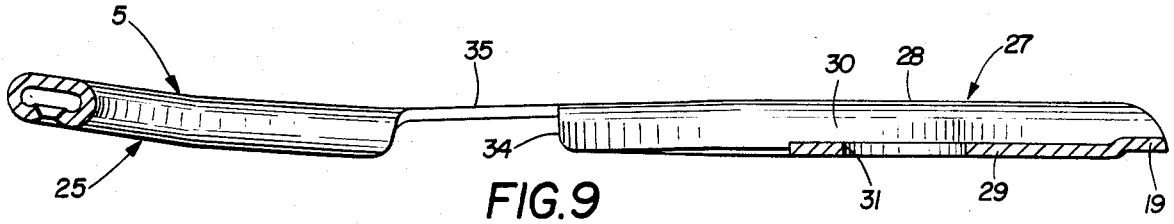
FIG. 9 is a longitudinal section through the pull tab of FIGS. 7 and 8 taken on the line 9—9, FIG. 7.

The outer lateral edges of the nose top panels 28 are formed with reinforcing beads 33 (FIGS. 7, 8, 11 and 12) which, along with the inner shoulder walls 30, act to maintain rigidity against bending of the nose top panels 28, particularly on any bend zones extending laterally of the top panels 28 between the tip 19 and the rear ends of the beads 33 and the shoulder walls 30. As best shown in FIGS. 7 and 8, the beads 33, the nose top panels 28, the shoulder walls 30, and the nose bottom panel 29 converge toward and form the tip 19 of the pull tab nose portion 27.

The rear ends 34 of the flat nose top panels 28 terminate in edges extending at right angles to a pull tab center line coinciding with the section line 9—9 (FIG. 7) which extends through the tip 19 and rivet opening 31. Similarly the rear ends of the beads 33 and shoulder walls 30 terminate at the same location, thereby modifying the prior art construction. In this manner, the pull tab ring portion 25 connection with the nose portion 27 is weakened. The connection consists only in the flat metal strips 35 which extend in the plane of and from a portion of the flat nose top panels 28 adjacent the right angle rear ends 34 thereof.

Figure 14:
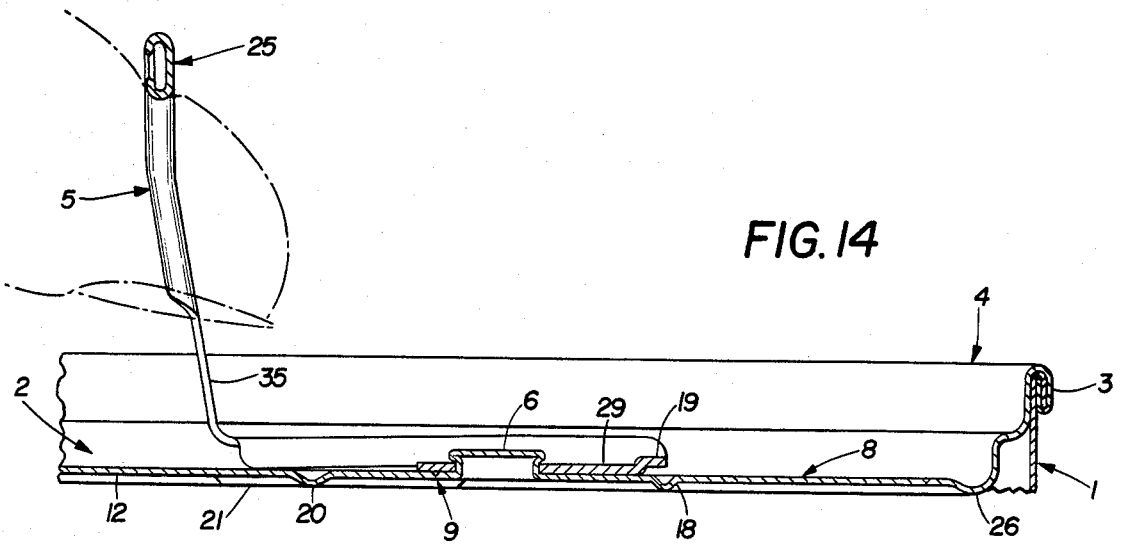
FIG. 14 is a sectional view similar to a portion of FIG. 5 but with the can end seamed to the can side wall, and looking in the other direction showing the first stage of manipulation of the ring portion of the pull tab to bend the pull tab at its weakened portions to move the pull portion to a generally vertical position extending generally at right angles upward from the can end panel.
Figure 15:
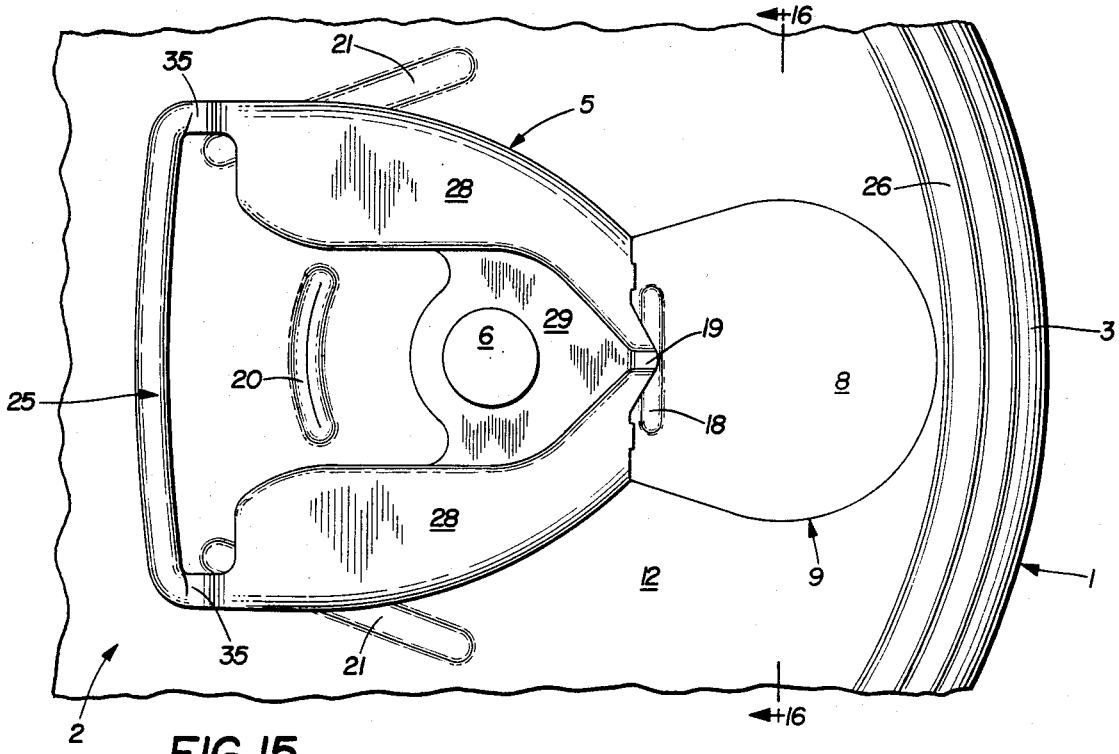
FIG. 15 is a fragmentary plan view of the parts shown in FIG. 14.
Figure 16:
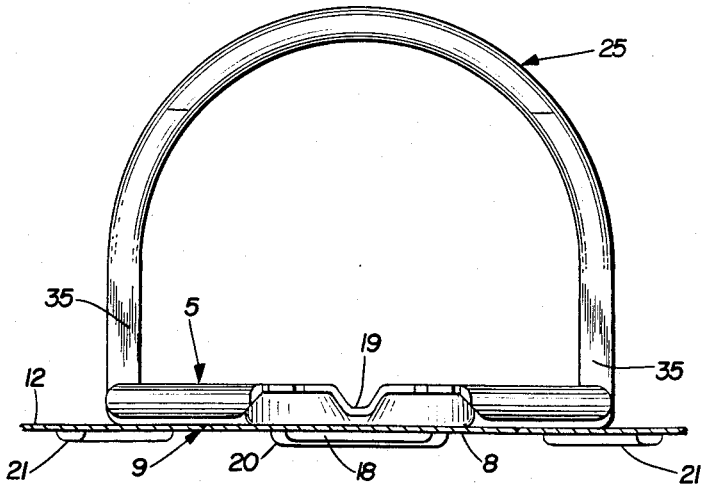
FIG. 16 is a fragmentary sectional view looking in the direction of the arrows 16—16, FIG. 15.

In this manner the pull tab 5 is substantially weakened as compared with the prior pull tab so that the pull tab may be readily bent across the flat metal strips 35 in order that the nose ring portion 25 may be moved upward with respect to the nose portion 27 to a position such as illustrated in FIGS. 14, 15 and 16.

FIG. 14 illustrates the steel can end 4 seamed at 3 to the can 1 which has been filled with the special liquid product to be protected against contamination. It also illustrates the new pull tab 5 riveted to the can end at 6 extending flatwise along the central portion of the circular panel 12. The orientatation, however, of the pull tab 5 in FIG. 14 is the reverse of the illustration of the pull tab 5 in FIG. 5. FIG. 5 looks in the direction of the arrows 5—5, FIG. 4, while FIG. 14 looks in the other direction.

The can in FIG. 14 is grasped in one hand of a person opening the can and with a thumb or finger of the other hand, as indicated in dot-dash lines in FIG. 14, the pull ring portion 25 of the pull tab 5 is pulled upward from the position shown in FIG. 5 generally to the location shown in FIG. 14. This upward pull bends the pull tab across the flat metal strip portions 35 adjacent right-angled edges at the rear ends 34 of the flat nose top panels 28.

Figure 17:
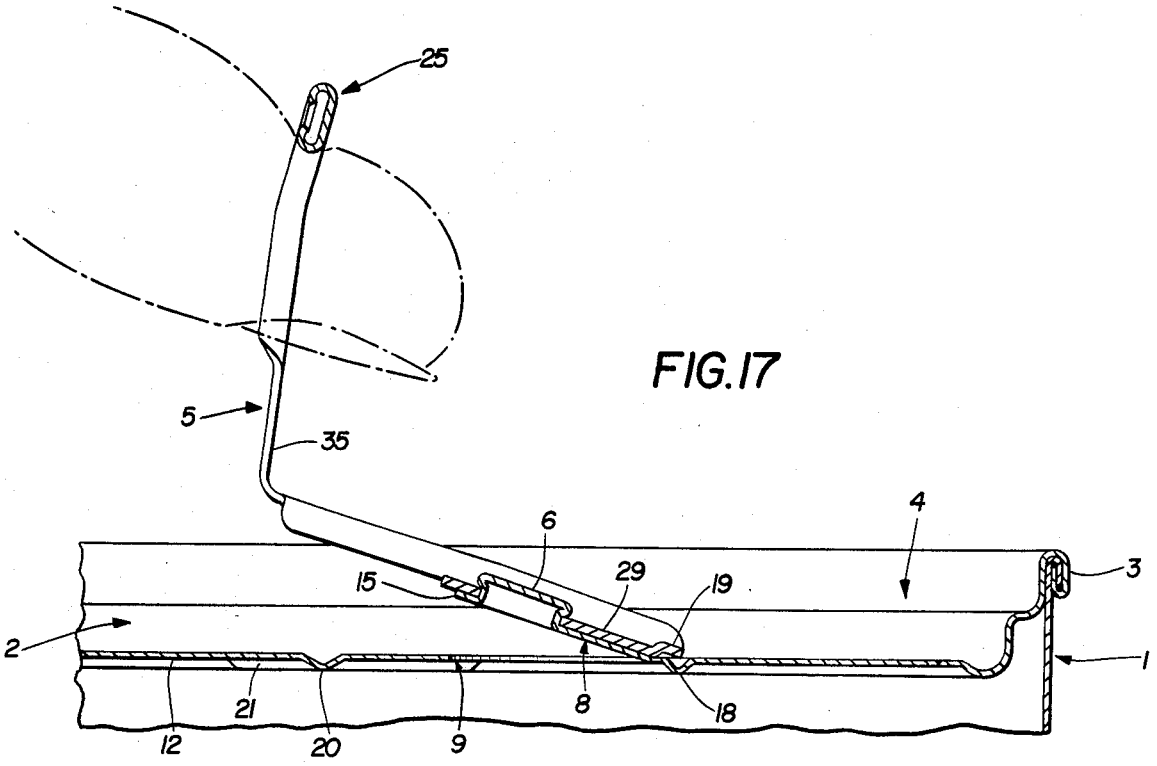
FIG. 17 is a view similar to FIG. 14 showing a next stage in pull ring manipulation in which the pull ring portion is pulled forward with respect to the pull tab nose portion and showing the initial rupture of the panel metal at the rear of the rivet along the endless score line defining the pouring opening to be formed in the can end panel.

The upward pull, accompanied by pulling toward the person holding the can, is continued as illustrated in FIG. 17. The flat nose bottom panel 29 and the portion of the metal area 8 below said panel 29 riveted to and in contact with the flat nose bottom panel 29, jointly act as a lever, as shown, to tear a rear portion of the metal area 8 behind and around the rivet 6. This tearing or rupture occurs at the inner rounded score line end 15. Tearing continues along the score line 9 while movement of the stepped tip 19 is not restricted because of the clearance of the tip recess 18 immediately below the pull tab tip 19.

This stage of the opening procedure illustrated in FIG. 17 may be easily carried out in the manner described because of the lever action and the minimum resistance to tearing described.

Figure 18:
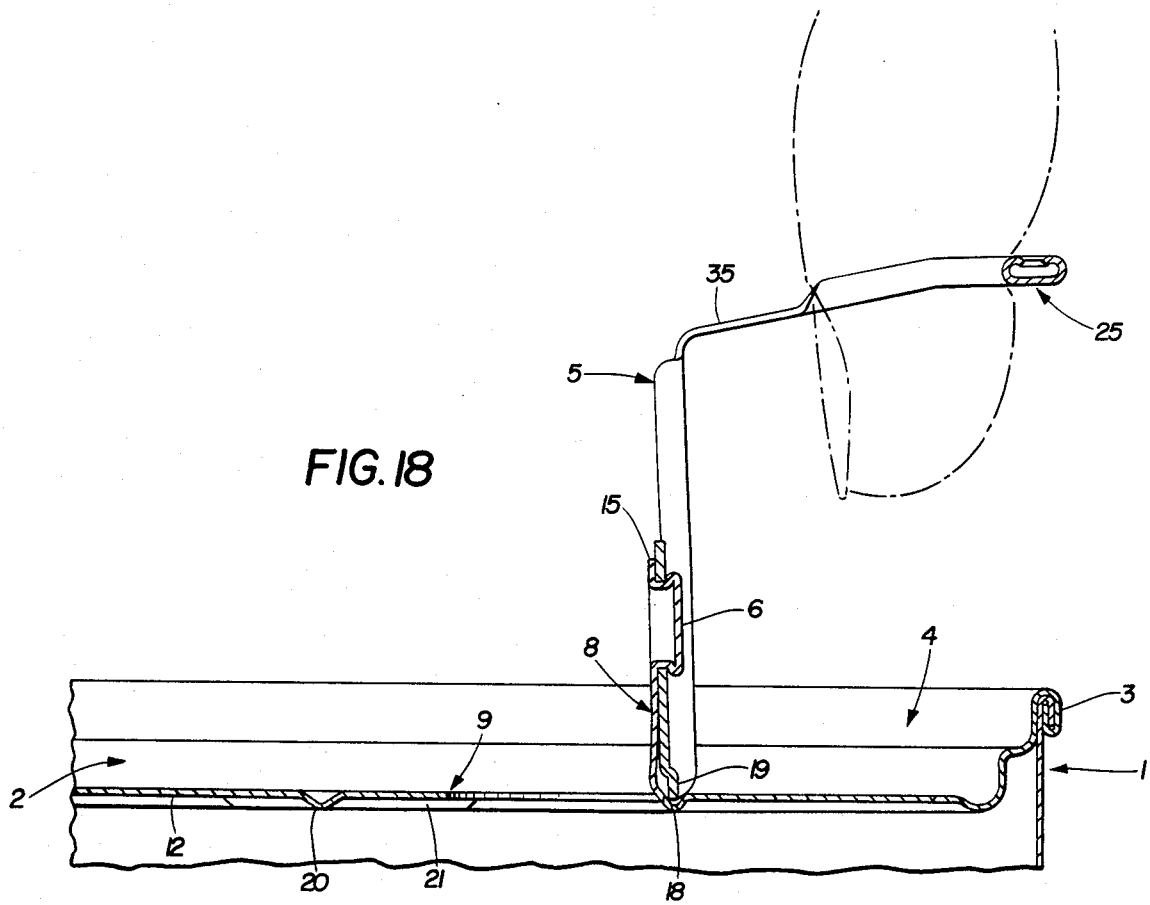
FIG. 18 is a fragmentary view similar to FIGS. 14 and 17 showing the next stage in pull tab manipulation in which the tip of the pull tab nose portion has entered a recess in front of the rivet and has bent the panel metal being removed along the recess in front of the rivet to a position extending upward from and at substantially right angles to the can end member flat metal panel portion.

The next stage in the opening procedure is illustrated in FIG. 18 wherein the pull tab continues to be pulled forward by the person opening the can, which bends the metal area 8 being removed, while the pull tab tip 19 bottoms in the recess 18 and acts as a bending fulcrum, until the parts reach the position generally shown in FIG. 18.

The final stage of opening the can is illustrated in FIG. 19. The pull tab and metal area 8 generally have the configuration shown in FIG. 18 and tearing continues along the score line 9 by continued pulling of the pull tab forward and downward by the person opening the can until the metal area 8 is completely torn off at the outer rounded end portion 16 of the score line.

The bending of the pull tab in the initial opening stage of FIG. 14 is also illustrated in FIGS. 15 and 16 with the pull ring portion 25 extending upward from the top of the can before initiating tearing of the metal along the score line.

Figure 20:
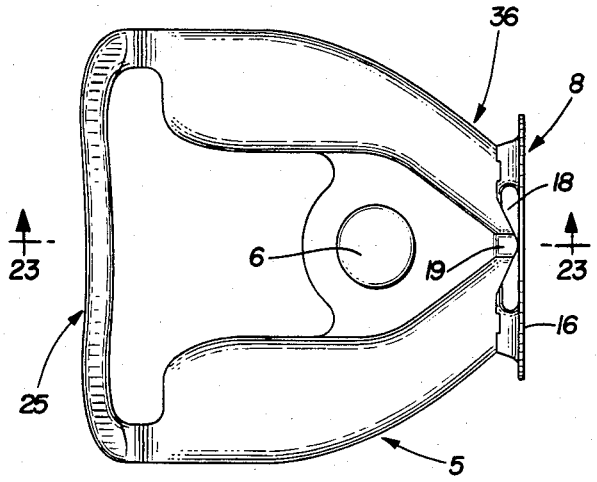
FIG. 20 is a top plan view of the bent pull tab and the torn out portion of the panel removed from the can end member to provide the opened can shown in FIG. 6.
Figure 21:
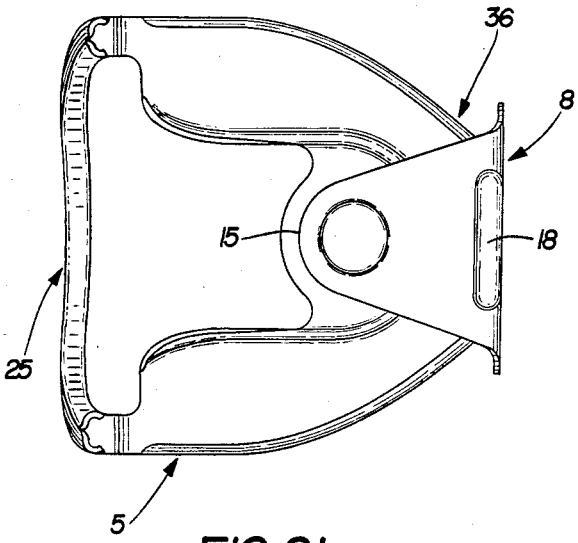
FIG. 21 is a bottom plan view of the bent pull tab and removed panel metal illustrated in FIG. 20.
Figure 22:
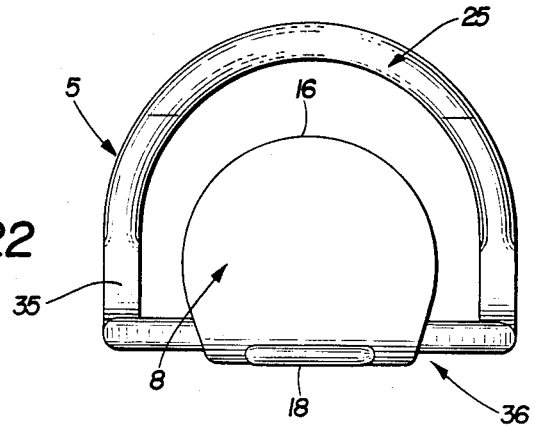
FIG. 22 is an end view looking toward the right end of FIG. 20.
Figure 23:
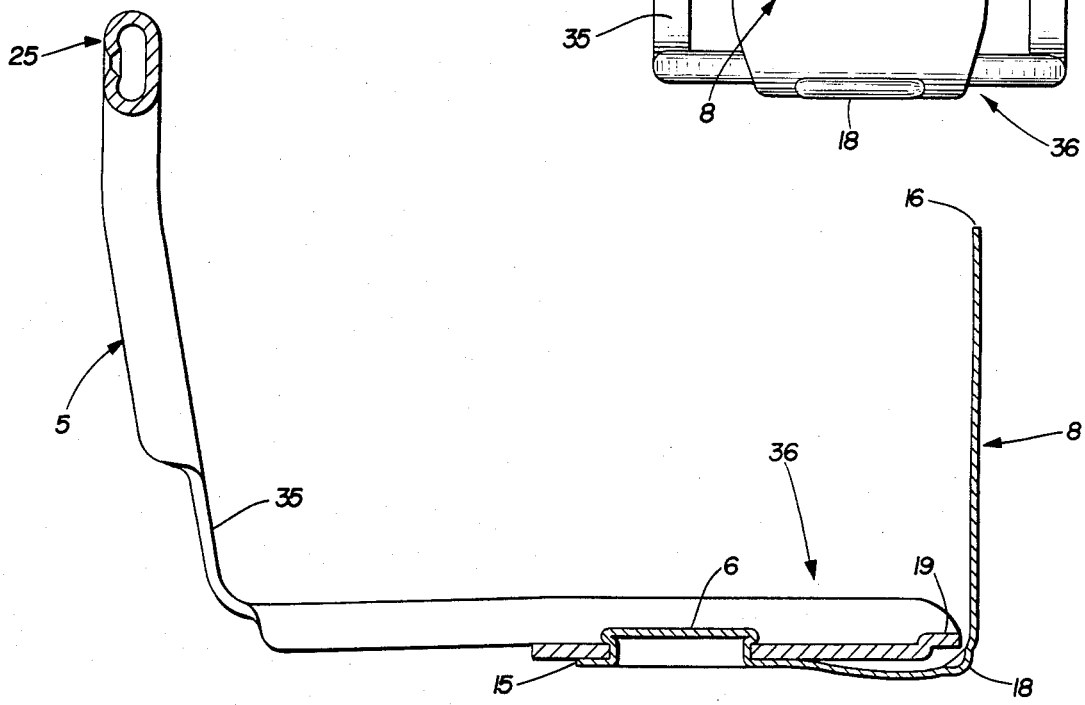
FIG. 23 is an enlarged sectional view taken on the line 23—23, FIG. 20.

FIGS. 20 to 22 illustrate the bent pull tab 5 and the metal area 8 torn as a unit completely from the can end circular panel 12 to form the pouring opening 7 illustrated in FIG. 6. This assembly of the aluminum pull tab and steel can end metal parts riveted together, in its torn-out unit condition, has the unusual configuration shown and generally indicated at 36. The assembled parts 36 are discarded by the person opening the can in a safe manner.

Important facets of the new can end and pull tab assembled construction 2 include the new mode of opening the can 1 which is enabled by the modifications from prior devices present in the new steel can end 4 and in the aluminum pull tab 5 described and which form the can end assembly.

The new mode of can opening enabled by the modified components of the can end assembly 2, and the cooperative interrelationships between the modified components of the assembly 2 provide a further new result. The can is opened by completely tearing out the metal along the endless score line which defines the pouring opening, and is accomplished without in any manner or at any time projecting any pull tab or panel metal into the can, thereby completely preventing any contamination of the contents of the can.

Accordingly, the new modified steel can end and aluminum pull tab assembly construction, having the various detailed features described, provides, when seamed to a can filled with special liquid food products, an easily opened can to form a pouring opening of special pear-shaped configuration, without contaminating the contents of the can, provides for a new mode of completely tearing out can end metal to form the pouring opening, provides a construction wherein bulging of the circular can end panel, incident to heat processing the contents of the can, does not project the centrally located pull tab riveted to the circular panel to interfere with can handling mechanism, and provides a new construction which satisfies the indicated objectives simply and efficiently with a low construction cost, and which obtains the new results described and solves existing problems in the field of steel cans for special liquid products which must not be contaminated.

In the foregoing description, certain terms have been used for brevity, clearness and understanding; but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described, since the features of the invention may be applied to different sizes and types of cans and steel can ends.

Having now described the features, discoveries and principles of the invention, the manner in which the improved structure achieves the objectives, and the advantageous, new and useful results obtained; the new and useful structures, devices, elements, arrangements, parts, cooperative relationships, and combinations are set forth in the appended claims.

We claim:

1. In a steel can end of a type having a seam flange adapted to be connected by seam means to a can body, in which said can end has a recessed corner located below said seam flange with a flat circular panel extending inward from said recessed corner, in which a score line is formed in said panel defining a metal area to be torn from said panel by an aluminum pull tab having a ring portion and a nose porrtion, and in which said nose portion is riveted to said metal area so that pulling of the pull tab tears said metal area from the panel to form a pouring opening, wherein the improvement comprises:

(a) a steel can end having an endless score line formed in said panel, in which said score line has a generally pear shape extending radially from a small rounded inner end located adjacent the center of the panel to a larger rounded outer end located adjacent the periphery of the panel, and has outwardly diverging straight sides connecting said inner and outer rounded ends to define the pouring opening to be formed in the can end panel;

(b) the nose portion of said aluminum pull tab riveted to said panel metal area has flat top and bottom panels and an enlarged rivet opening formed in said nose bottom panel, the nose bottom panel being integrally connected laterally at each side of said rivet opening through spaced inner nose shoulder walls directly with said nose top panel, said nose top and bottom panels and spaced shoulder walls converging to form a stepped tip, and said integral lateral connections of the nose bottom panel with the nose top panel strengthening and stiffening said flat nose bottom panel against bending between said rivet opening and said stepped tip when the pull tab is pulled to form a pouring opening in said can end panel;

(c) the can end panel metal area within the small rounded inner end of said pear-shaped endless score line is formed with concentric integral rivet means which extends through said enlarged rivet opening in said flat nose bottom panel and is riveted to said flat nose bottom panel, whereby the stiffened flat nose bottom panel is held at all times in contact with said can end panel metal area within said score line; and (d) the ring portion of said pull tab integral with said nose portion has weakened connection with said nose portion to permit ready bending of the pull tab at said weakened connection when the pull tab is pulled to form a pouring opening in said can end panel;

(e) whereby the metal area within the endless score line may be completely torn from the can end by a person holding the can in one hand and grasping the tab pull ring portion with a finger or thumb of the other hand and pulling the tab ring portion upward and forward toward the person to first bend the pull tab at said weakened connection and then to initially rupture the score line behind and around the rivet means, accompanied by lever action of the contiguous pull tab nose flat bottom panel and contacted can end metal area within the score line applied by pull tab nose tip engagement with said metal area to form a bend in said metal area in front of said nose tip while tearing along the score line to such bend, and then by continuing forward pulling, completely tearing the metal area from the can end panel along the remainder of the score line to the rounded outer end of the score line to form a pouring opening.

2. The steel can end defined in claim 1 in which a plurality of downward embossed recesses are formed at a number of locations in the flat circular metal panel to maximize the maintenance of a condition of panel flatness and to resist panel distortion during opening of the can.

3. The steel can end defined in claim 2 in which one of said recesses comprises a short, straight tip recess located close to and in front of the panel integral rivet means and also located beneath and spaced from the pull tab stepped tip, in which the tip recess provides clearance for tip movement downward into the recess valley during initial pull tab opening movement before said stepped tip engages circular panel metal in said recess, and in which initial opening-movement-upward pull on the ring portion of the pull tab ruptures metal along the small rounded inner end of the score line at the rear of and around the rivet means before the stepped tip engages panel metal in said tip recess.

4. The steel can end defined in claim 3 in which continued upward pull on the pull tab accompanied by forward pull after said initial rupture, proceeds to continue score line rupture along said score line outwardly diverging straight sides, free of restraint against movement of said stepped tip until said stepped tip contacts panel metal in said tip recess.

5. The steel can end defined in claim 2 in which another of said recesses comprises a crescent shaped recess located behind said rivet means and outside of said score line small rounded inner end to stiffen said flat circular panel.

6. The steel can end defined in claim 5 in which other of said recesses comprise two angularly arranged straight recesses located spaced from and straddling the ends of said crescent shaped recess to assist in maintaining flatness of said flat circular panel.

7. The steel can end defined in claim 2 in which another of said recesses comprises an embossed thumb recess having a horseshoe shape located adjacent and extending from the periphery of said flat circular panel in a ramplike manner toward the center of said panel beneath the pull tab ring portion for enabling a finger to be entered below the ring portion of the pull tab for pulling said ring portion upward to bend said ring portion upward to initiate can opening operation.

8. The steel can end defined in claim 2 in which another of said recesses comprises a shallow circular bead-like embossed recess located at the periphery of said circular panel connecting said panel with and formed as a part of the recessed corner below the can end seam flange to maintain panel flatness and strength against rupture of the score line in event that a filled can is accidentally dropped.

9. The steel can end defined in claim 1 in which a short straight downward embossed tip recess is located in the flat circular metal panel close to and in front of the panel integral rivet means and also located beneath and spaced from the pull tab stepped tip, and in which said tip recess provides clearance for tip movement downward into the recess valley during initial pull tab opening movement before said stepped tip engages circular panel metal in said tip recess.

10. The steel can end defined in claim 9 in which the stepped tip engages panel metal in said tip recess during opening movement of the pull tab, in which said flat nose bottom panel riveted to and held in contiguous contact with said can end panel metal area acts as a lever when said stepped tip engages panel metal in said tip recess to bend said metal area along a bend line parallel to said straight tip recess during later opening movement of said pull tab, and in which said metal area after being bent is completely torn from the flat circular panel during final opening movement of said pull tab.

11. The steel can end defined in claim 10 in which a plurality of other downward embossed recesses are formed at a number of locations in said flat circular metal panel to maintain flatness during can opening movement of the pull tab.

12. The steel can end defined in claim 1 in which said weakened connection between said ring portion and said nose portion comprises flat metal strips extending from portions of and in the plane of said flat nose top panels.

13. The steel can end defined in claim 12 in which the rear ends of the flat nose top panels terminate in edges extending at right angles to a center line of the pull tab extending through the stepped tip and through said flat nose bottom panel rivet opening, in which said flat metal strips extend in the same plane as that of and from portions of said right angled edges of the rear ends of said flat nose top panels.

14. The steel can end defined in claim 13 in which said weakened flat metal strip connections enable the pull tab ring portion to be moved, by bending said flat metal strips adjacent said right angled top nose panel edges, to a location extending upward from said flat circular panel to initiate can opening movement of said pull tab.

* * * * *